US005772292A

United States Patent [19]

Touzani et al.

[11] Patent Number: 5,772,292

[45] Date of Patent: Jun. 30, 1998

[54] MOVABLE SHELF ASSEMBLY AND COMBINATON MOVABLE SHELF ASSEMBLY AND COMPUTER DESK

[75] Inventors: William Nabil Touzani; Ouadie Touzani, 52 BD. Abdelmoumen Flat #161, both of Casablanca, Morocco

[73] Assignee: Ouadie Touzani, Casablanca, Morocco

[21] Appl. No.: 582,460

[22] Filed: Jan. 3, 1996

Related U.S. Application Data

[63] Continuation-in-part of Ser. No. 506,075, Jul. 24, 1995, abandoned.

[51] Int. Cl.[6] ..... A47B 81/00

[52] U.S. Cl. ..... 312/208.1; 312/223.3; 312/297; 312/273; 108/93

[58] Field of Search ..... 312/223.3, 297, 312/271, 273, 310, 334.1, 334.12, 334.7, 208.1, 196, 309, 282, 29; 248/918; 108/50.011, 93, 92, 138

[56] References Cited

U.S. PATENT DOCUMENTS

| | | | |
|---|---|---|---|
| 4,511,111 | 4/1985 | Godfrey et al. | 248/918 X |
| 4,717,112 | 1/1988 | Pirkle | 248/918 X |
| 4,986,616 | 1/1991 | Chang et al. | 108/138 X |

*Primary Examiner*—Jose V. Chen
*Assistant Examiner*—Janet M. Wilkens
*Attorney, Agent, or Firm*—Ladas & Parry

[57] ABSTRACT

A computer desk having a movable shelf is provided. The desk has an upper shelf for receiving a part of a computer, and a movable lower shelf positioned below the upper shelf for receiving another part of the computer. The movable lower shelf is mounted in the desk so that it moves outwardly from the desk such that at least a portion of the lower shelf is in a position which is longitudinally forward of and sufficiently closely adjacent to the upper shelf so as to extend the total desktop surface of the computer desk.

16 Claims, 3 Drawing Sheets

MOVABLE SHELF ASSEMBLY AND COMBINATON MOVABLE SHELF ASSEMBLY AND COMPUTER DESK

The present application is a continuation-in-part of U.S. Ser. No. 08/506,075, filed Jul. 24, 1995 now abandoned.

The field of the invention relates to a movable shelf for use with a computer desk and to combinations of such a shelf and a computer desk. The invention also relates to a rail assembly for use with a movable shelf.

BACKGROUND OF THE INVENTION

A typical computer desk is composed of a desktop surface for receiving part of a computer system, such as the computer, a CRT monitor, and a keyboard required to access the computer. The keyboard is usually placed on the desktop surface or surfaces at a forward position and at a comfortable distance from the operator's knees. Computer desks comprising an additional movable shelf placed directly below a stationary upper shelf are generally more compact than other desks and therefore more suitable for small office and home use. In such computer desks, the total desktop surface therefore includes the stationary part or upper shelf and the movable part or lower shelf.

Computer desks with this split desktop can easily accommodate a keyboard, a mouse and a mouse pad. The disadvantage created by the split desktop, however, is the resulting large gap of space created between the upper shelf and the movable lower shelf which is needed to accommodate the keyboard unit during storage, but which makes handling documents and small objects on such surface more difficult. Additionally, in order to maintain the monitor and the upper shelf at appropriate levels, the movable lower shelf is forced to a lower position than desirable resulting in insufficient leg room for the operator and substantial strain to the body.

Accordingly, it is an object of this invention to provide a means by which the combined desktop surface of a computer desk is increased as a result of extending the movable shelf from an inner position in the desk to an outer position. In one embodiment of the invention, the movable shelf is guided along longitudinally extending guide means in the form of a U-shaped channel or rail assembly mounted in the computer desk, the rail assembly comprising upper and lower parallel horizontal channels, and longitudinally spaced channels connecting the upper and lower horizontal channels. In another embodiment of the invention the movable shelf comprises two levels. In a further embodiment of the invention, the computer desk has a conventional shutter door which is movable from an open position exposing the upper shelf to a closed position concealing the upper shelf or concealing the space defined between the upper shelf and the movable lower shelf. The shutter door may also extend further to conceal other shelves in the desk. The use of the shutter door may be desirable when the operator is away from the desk and wishes to hide work documents, software or hardware from unauthorized people. In other embodiments of the invention, vertical or horizontal movement of the shutter door or doors is coupled with the movement of the lower shelf.

SUMMARY OF THE INVENTION

In accordance with the invention, there is provided a computer desk which comprises an upper shelf for receiving a part of a computer, a movable lower shelf positioned below the upper shelf for receiving another part of the computer, and means for mounting the movable lower shelf so that it moves outwardly from the desk such that at least a portion of the lower shelf is in a position which is longitudinally forward of and sufficiently closely adjacent to the upper shelf so as to extend to the total desktop surface of the computer desk.

In accordance with the invention, there is also provided a movable shelf for mounting in a computer desk, wherein the movable shelf has means attached thereto for supporting and guiding the shelf forwardly and outwardly from the desk, the means comprising two longitudinally spaced protruding devices positioned on each side of the movable shelf, and the protruding devices being adapted to support and guide the shelf along a path as the shelf moves forwardly and outwardly of the desk.

In accordance with the invention there is further provided a movable shelf for mounting in a computer desk, the movable shelf having a lower section for storing a computer keyboard in the computer desk when the computer is not in use, and an adjacent upper section located forwardly of the lower section for receiving the computer keyboard when the computer is being used.

According to the invention, there is also provided a rail assembly for mounting in a computer desk, in which the rail assembly is adapted to receive protruding devices mounted on opposite sides of a movable shelf, and the movable shelf is adapted to move along said rail assembly, the rail assembly comprising transversely opposed upper and lower longitudinally extending horizontal channels and longitudinally spaced transversely opposed sloping channels connecting the upper and lower horizontal channels. Optionally, a pair of the protruding devices is mounted on plate means. The plate means is attachable to opposite sides of the movable shelf, and the longitudinal distance between the protruding devices on each plate means corresponds to the longitudinal spacing between the connecting channels of the rail assembly.

DETAILED DESCRIPTION OF THE INVENTION

Figure 1:
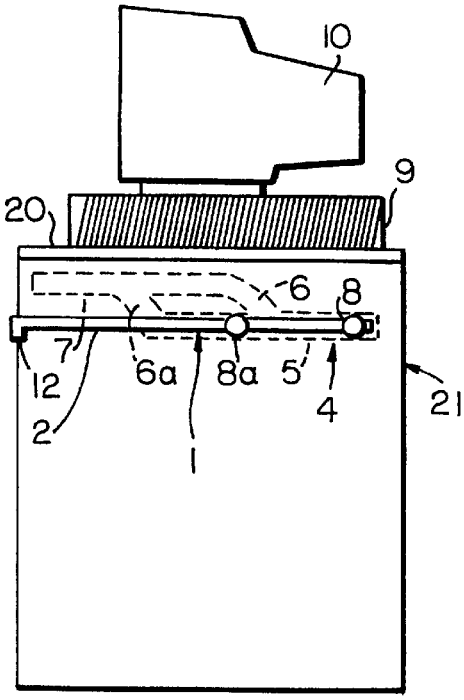
FIG. 1 a vertical cross-section of an end view of a computer desk in accordance with the invention with a movable shelf assembly taken through a side edge of the movable shelf, the movable shelf being shown in the unextended state.

FIG. 1 illustrates a computer desk 21 having a movable shelf assembly generally denoted by 1 comprising a sliding shelf 2, a grip or handle 12, and at least two longitudinally spaced protruding devices 8 and 8*a*, the desk further having a grooved U-shaped channel or rail assembly 4. Channel or rail assembly 4 includes a lower substantially horizontal channel 5, parallel channels 6 and 6*a*, and a higher horizontal channel 7. Computer 9 and monitor 10 are placed on top of upper shelf 20 while keyboard 11 has been omitted for clarity. Other arrangements of the computer hardware are also possible.

Figure 2:
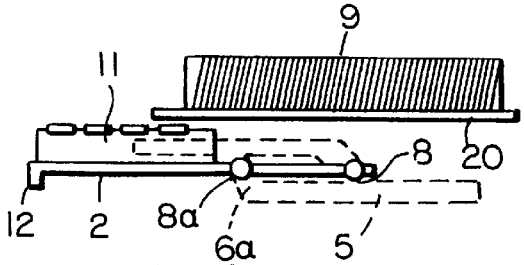
FIG. 2 partial cross-section of the movable shelf assembly of FIG. 1 with the keyboard in place, the movable shelf being shown in a partially extended state.

In FIG. 2, the movable shelf is in an intermediate position between lower channel 5 and higher channel 7. All channels can take the form of either a U-shaped channel or rail assembly. Protruding devices 8 and 8*a* are shown as integral to shelf 2, but can also be separate devices attachable to shelf 2 and channel 4, and simultaneously guided along channels 6 and 6*a*. Movable shelf assembly 1 and keyboard 11 are maintained in a substantially horizontal state as they move from an inner position to an outer position and from a lower level to a higher level.

Figure 3:
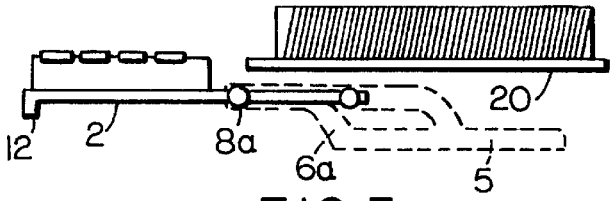
FIG. 3 is a further partial cross-section of the movable shelf assembly of FIG. 1, the movable she being shown in the extended state.

In FIG. 3 movable shelf assembly 1 is closest to upper shelf 20 providing additional leg room for the operator, and a virtually continuous extended desk top surface.

Figure 4:
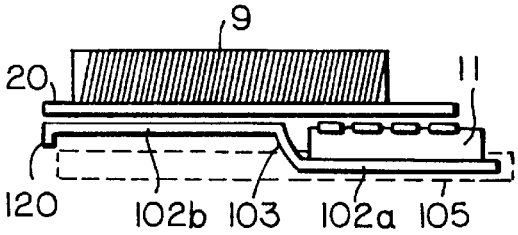
FIG. 4 is a vertical cross-section of an end view of a second embodiment of a movable shelf assembly in which the shelf has two levels and the key board is shown on the lower level, shelf being shown in the unextended state.
Figure 5:
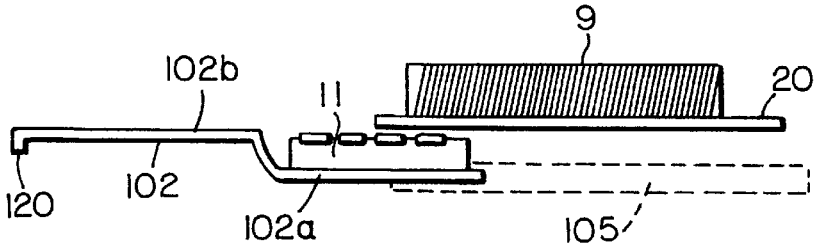
FIG. 5 is a further vertical cross-section of the movable shelf assembly of FIG. 4 with the keyboard shown on the lower level, the shelf being shown in a partially extended state.

FIG. 4 shows a movable shelf 102 made of at least two sections 102*a* and 102*b* guided along channel 105. Section 102*b* is located at the front and nearest to upper shelf 20 and has handle or grip 120, while section 102*a* is located towards the back and at a lower level than section 102*b*. When the movable shelf is in its unextended state, keyboard 11 is positionable only on section 102*a*, making it an ideal storage compartment for the keyboard. The two sections can be part of an integral unit or bridged by external means to produce a sloping section 103:

In FIG. 5 the same movable shelf 102*a*, 102*b* is in a forward position allowing the displacement of keyboard 11 from lower section 102*a* to higher section 102*b* without interference from upper shelf 20.

Figure 6:
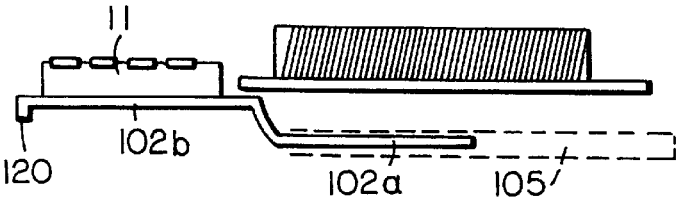
FIG. 6 is a further vertical cross-section of the movable shelf assembly of FIG. 4 with the keyboard shown on the upper level, the shelf being shown in the extended state.

FIG. 6 shows the desired position of movable shelf 102*a*, 102*b* during computer use. Keyboard 11 is still located on the same shelf but has simply been moved manually forward and higher, from section 102*a* to section 102*b*. At this location it is considered an extension of upper shelf 20 and provides more knee room for the operator.

Figure 7:
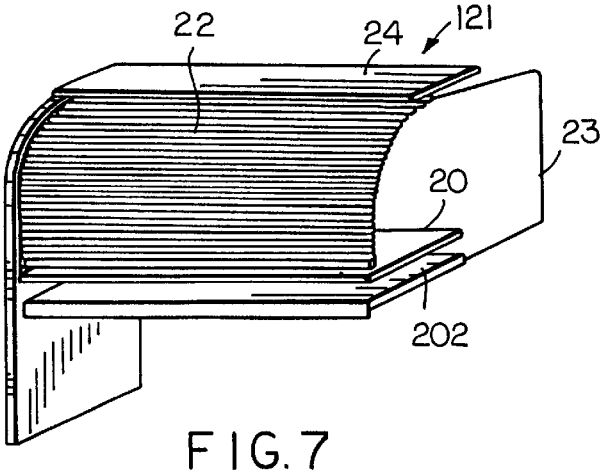
FIG. 7 is a top, front, right side, perspective view of a third embodiment of a computer desk in accordance with the invention with a movable shelf assembly, the movable shelf being shown in the unextended state and the shutter door being shown in the closed position with the right side panel of the desk removed.

In FIG. 7 computer desk 121 is shown with a vertical shutter door 22 in its closed position, substantially covering upper shelf 20. Movable shelf 202 is in this case attached to shutter door 22 via connector means 23, the connector means being formed of a rigid material. Any extension of the movable shelf is coupled with the raising of the shutter door as it is guided along track means such as U-shaped channels or rails 104, thereby exposing upper shelf 20. Movable shelf 202 can be connected to any portion of the shutter door. Shutter door 22 may also extend below the upper shelf in order to cover other shelves. In such a case, it is necessary to displace the shutter door away from the path of extendible shelf 202 so that the door can extend further. The advantage of this embodiment is the unnecessary use of grips or handles on the shutter door since, in a single operation, as the movable shelf is extended, the shutter door is opened. Optionally, the shutter door is closed by movement of the movable shelf inwardly.

Figure 8:
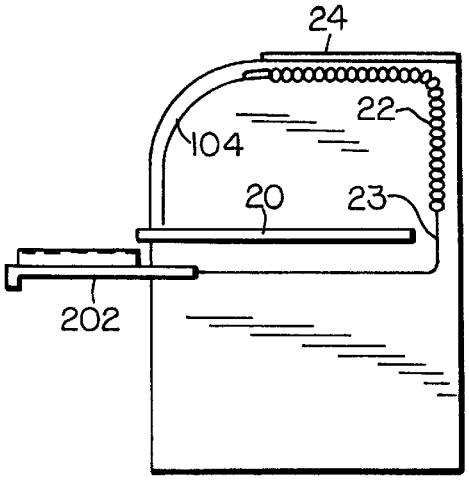
FIG. 8 is a vertical cross-section of an end view of the movable shelf assembly of FIG. 7 taken through a side edge of the movable shelf, the movable shelf being shown in the extended state and the shutter door being shown in the open position.

FIG. 8 illustrates the computer desk of FIG. 7 in its open or in use position.

Figure 9:
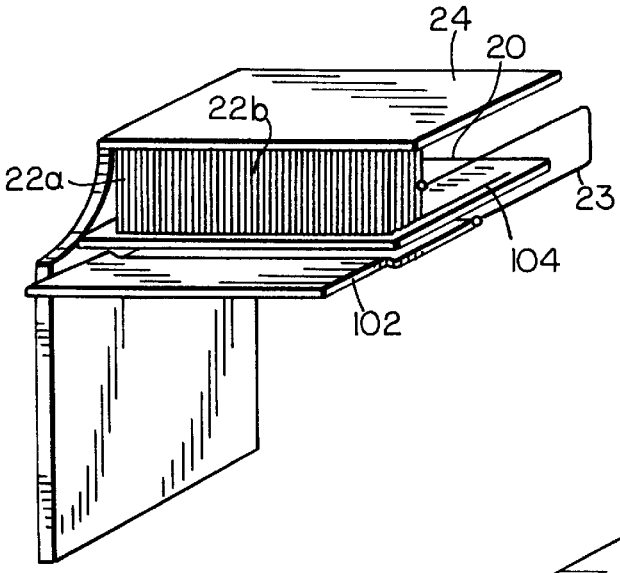
FIG. 9 is a top, front, right side perspective view of a fourth embodiment of a computer desk in accordance with the invention with a movable shelf assembly, the movable shelf being shown in the unextended state and the shutter door being shown in the closed position with the right side panel of the desk removed.

FIG. 9 shows a computer desk with a separate shelf 24 for the monitor, and a set of closed horizontal shutters capable of sliding sideways as movable shelf 102 is extended. Movable shelf 102 is attached to shutter doors 22*a* and 22*b* by means of connector assembly 23, the connector assembly being similar to that in FIG. 7. In this embodiment of the invention, the use of handles on the shutter doors is not required since, in a single operation, as the movable shelf is extended the shutter doors are opened. Optionally, the shutter doors are closed by movement of the movable shelf inwardly.

Figure 10:
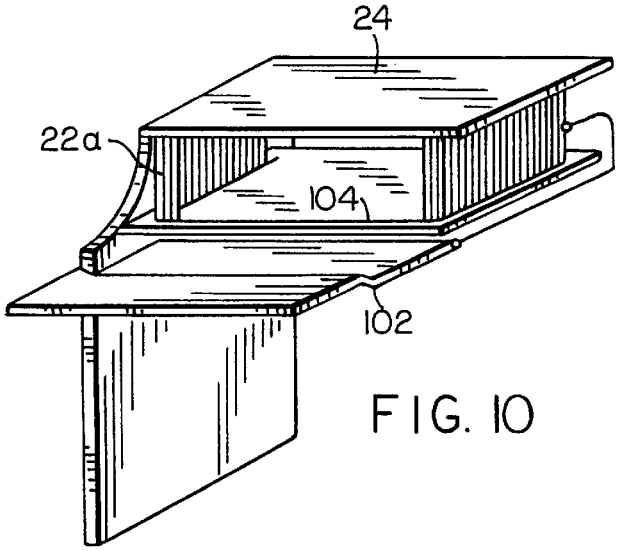
FIG. 10 is a further perspective view of the movable shelf assembly of FIG. 9, the movable shelf being shown in the extended state and the shutter door being shown in the open position with the right side panel of the desk removed.

FIG. 10 shows the computer desk of FIG. 9 in its open or in use position.

Figure 11:
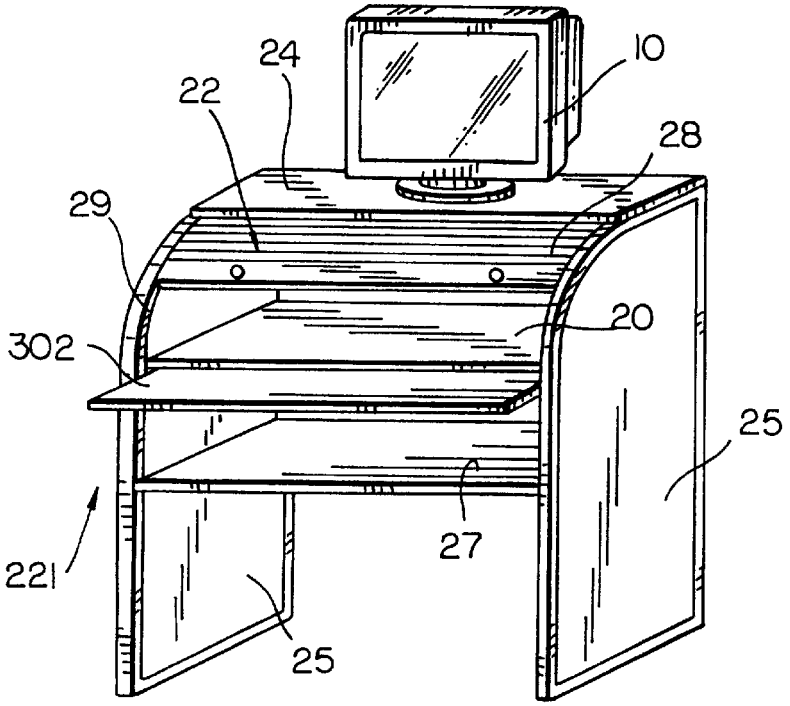
FIG. 11 is a top, front, right side perspective view of a computer desk such as shown in FIG. 1 with a simple sliding shelf shown in the extended state and the shutter door partially open.
Figure 12:
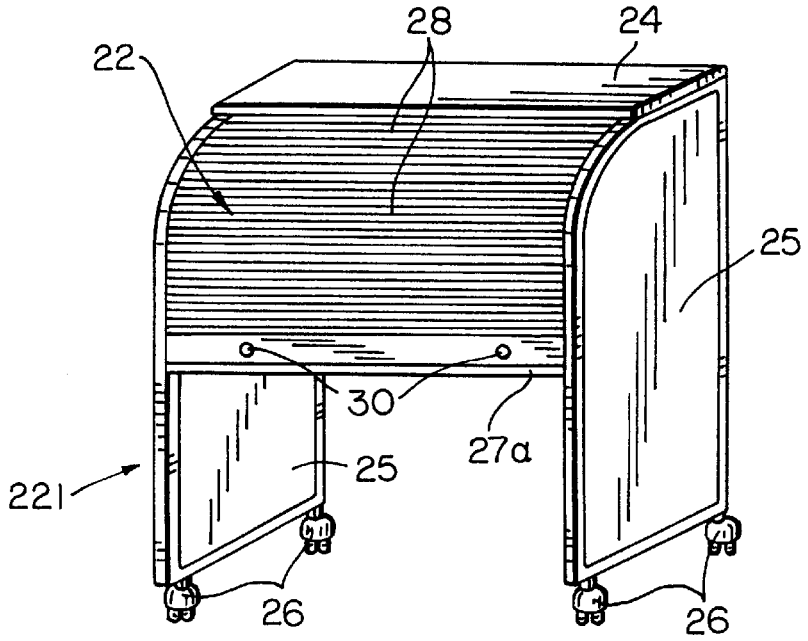
FIG. 12 is a further perspective view corresponding to FIG. 11 omitting the computer and wit the sliding shelf shown in the unextended state and concealed from view by the closed shutter door.

Referring to FIGS. 11 and 12, home computer desk 221 includes a housing comprising two side panels 25 and shelf 24 transversely fastened between the two side panels 25 and intended to support computer equipment such as monitor 10. The desk 221 may be of the movable kind, having a wheel assembly 26 affixed to the lower edges of the side panels 25 as shown in FIG. 12, or of the stationary kind as shown in FIG. 11.

The desk 221 further includes shelf 27 having front edge 27*a* transversely fastened between the two side panels 25, and movable shelf 302 and upper shelf 20, both shelves being positioned between shelf 24 and shelf 27 and disposed transversely between the two side panels 25.

The desk 221 further includes a sliding door or curtain 22 mounted between the two side panels 25 and movable from an open position below the shelf 24, as shown in FIG. 11 to permit access to movable shelf 302, to a closed position concealing at least the space defined between movable shelf 302 and monitor shelf 24 in order to prevent access to that space as shown in FIG. 12.

The sliding door 22 is made of adjacent elements or segments 28 which extend transversely to the direction of movement of door 22, each segment comprising a rod, a plate or a slat made of wood, plastic or metal, and the segments connected to each other through fastening means formed of a material which provides some mobility or flexibility of door 22.

The door 22 is slidingly mounted in two guiding grooves 29 provided in the two side panels 25, respectively, each groove 29 including a lower straight portion which extends into an upper curved portion. The flexibility of door 22 thus permits to it to glide freely in grooves 29.

In a preferred embodiment of the invention, door 22 is moved to its closed position below movable shelf 302 and is stopped at this position by the front edge 27*a* of shelf 27. To permit the manual movement of door 22, two handles, 30 are provided at the front of door 22.

When door 22 is in its open position, movable shelf 302 is extendable outwardly of desk 221 as shown in FIG. 11.

When an operator is finished using the computer or steps away from the computer desk, door 22 can be pulled down in grooves 29 from its upper position below shelf 24 after, if desired, sliding shelf 2 back in desk 221, to its closed position shown in FIG. 12 so that the computer equipment lodged in desk 221, is no longer accessible to unauthorized people.

I claim:

1. A computer desk which comprises an upper shelf for receiving a primary computer component, a movable lower shelf positioned below said upper shelf for receiving a computer keyboard, and means for movably supporting said movable lower shelf so that it moves outwardly from the desk such that at least a portion of the lower shelf is in a position which is longitudinally forward of and sufficiently closely adjacent to said upper shelf so as to extend the total desktop surface of said computer desk, wherein said movable lower shelf comprises a first horizontally aligned section and a second horizontally aligned section adjacent said first section which is forward of and elevated above said first section, each section having a flat upper surface which is aligned parallel to a lower surface of the upper shelf, the first horizontally aligned section being dimensioned so as to accommodate said keyboard for storage when the movable shelf is in an unextended state inside the computer desk, and the second horizontally aligned section being dimensioned so as to accommodate said keyboard when the movable shelf is moved into its extended state outwardly of the computer desk so that said keyboard is positioned for use in front of said primary computer component, whereby when said movable lower shelf is in the extended state, the first horizontally aligned section is sufficiently exposed such that said keyboard can be moved from the first horizontally aligned section to the second horizontally aligned section.

2. A computer desk as claimed in claim 1, further including at least one sliding door at the front thereof which is movable from an open position exposing said upper shelf to a closed position concealing said upper shelf.

3. A computer desk as claimed in claim 2, which includes means for connecting said at least one sliding door to said movable lower shelf such that movement of said lower shelf outwardly opens said at least one sliding door.

4. A computer desk as claimed in claim 3, wherein said means for connecting said at least one sliding door to said movable lower shelf comprises a cable.

5. A computer desk as claimed in claim 2, which includes means for connecting said at least one sliding door to said movable lower shelf such that movement of said lower shelf inwardly closes said at least one sliding door.

6. A computer desk as claimed in claim 5, wherein said means for connecting said at least one sliding door to said movable lower shelf comprises a cable.

7. A computer desk as claimed in claim 2, wherein said at least one sliding door comprises a single door movable at least partially in a vertical direction.

8. A computer desk as claimed in 7, wherein said sliding door is vertically disposed at the front of the desk and positioned so as to move from a closed position concealing said upper shelf to an open position fully exposing said upper shelf; and said desk further comprises means adjacent a side of said desk for accommodating the sliding door when the door is in the open position and the upper shelf is fully exposed.

9. A computer desk as claimed in claim 8, which further comprises means for connecting said sliding door with said movable lower shelf such that movement of said lower shelf outwardly opens said sliding door and movement of said lower shelf inwardly closes said sliding door.

10. A computer desk according to claim 2, wherein said at least one sliding door comprises two vertically disposed doors positioned so as to move horizontally in opposite directions, said sliding doors being movable together to a central position at the front of said desk and away from each other, and which includes track means adjacent to respective sides of said desk to receive the sliding doors when they move away from each other.

11. A computer desk as claimed in claim 10, wherein said desk further comprises means for connecting said sliding doors with said movable lower shelf such that movement of said lower shelf outwardly moves said sliding doors away from each other and movement of said lower shelf inwardly moves said sliding doors together.

12. A computer desk according to claim 1, wherein said movable lower shelf further includes a sloping section interconnecting said first and second horizontally aligned sections.

13. A movable shelf mountable in a computer desk, wherein said movable shelf comprises a first horizontally aligned section, a second horizontally aligned section which is forward of and elevated above said first section, and a sloping section bridging the horizontally aligned sections, the first horizontally aligned section being dimensioned so as to accommodate a keyboard for storage when the movable shelf is in an unextended state when mounted inside the computer desk, and the second horizontally aligned section being dimensioned so as to accommodate said keyboard when the movable shelf is mounted in said desk and is moved into its extended state outwardly of the computer desk so that said keyboard is positioned for use in front of a primary computer component on said computer desk, whereby said keyboard can be moved from the first horizontally aligned section to the second horizontally aligned section.

14. A computer desk which comprises:

an upper shelf for receiving a primary computer component, a movable lower shelf positioned below said upper shelf for receiving a computer keyboard, means for movably supporting said movable lower shelf so that it moves outwardly from the desk such that at least a portion of the lower shelf is in a position which is longitudinally forward of and sufficiently closely adjacent to said upper shelf so as to extend the total desktop surface of said computer desk, at least one vertically disposed sliding door at front of the desk positioned so as to move horizontally from a closed position concealing said upper shelf to an open position fully exposing said upper shelf; and means adjacent a side of said desk for accommodating the sliding door when the door is in the open position and the upper shelf is fully exposed, wherein said movable lower shelf comprises a first horizontally aligned section, a second horizontally aligned section adjacent said first section which in forward of and elevated above said first section, and a sloping section interconnecting the horizontally aligned sections, the first horizontally aligned section being dimensioned so as to accommodate said keyboard for storage when the movable shelf is in an unextended state inside the computer desk, and the second horizontally aligned section being dimensioned so as to accommodate said keyboard when the movable shelf is moved into its extended state outwardly of the computer desk so that said keyboard is positioned for use in front of a primary computer component on said computer desk, whereby said keyboard can be moved from the first horizontally aligned section to the second horizontally aligned section.

15. A computer desk which comprises:

an upper shelf for receiving a primary computer component, a movable lower shelf positioned below said upper shelf for receiving a computer keyboard, means for movably supporting said movable lower shelf so that it moves outwardly from the desk such that at least a portion of the lower shelf is in a position which is longitudinally forward of and sufficiently closely adjacent to said upper shelf so as to extend the total desktop surface of said computer desk, at least one vertically disposed sliding door at front of the desk positioned so as to move horizontally from a closed position concealing said upper shelf to an open position fully exposing said upper shelf; and means adjacent a side of said desk for accommodating the sliding door when the door is in the open position and the upper shelf is fully exposed, wherein said at least one vertically disposed sliding door comprises two said doors positioned so as to move horizontally in opposite directions, said sliding doors being movable together to a central position at the front of said desk concealing said upper shelf, and away from each other exposing said upper shelf, wherein said means comprises track means adjacent respective sides of said desk to receive the sliding doors when they move away from each other, and said desk including means for connecting said sliding doors with said movable lower shelf such that movement of said lower shelf outwardly moves said sliding doors away from each other and movement of said lower shelf inwardly moves said sliding doors together, and wherein said movable lower shelf comprises a first horizontally aligned section, a second horizontally aligned section adjacent said first section which is forward of and elevated above said first section, and a sloping section interconnecting the horizontally aligned sections, the first horizontally aligned section being dimensioned so as to accommodate said keyboard for storage when the movable shelf is in an unextended state inside the computer desk, and the second horizontally aligned section being dimensioned so as to accommodate said keyboard when the movable shelf is moved into its extended state outwardly the computer desk so that said keyboard is positioned for use in front of a primary computer component on said computer desk, whereby said keyboard can be moved from the first horizontally aligned section to the second horizontally aligned section.

16. A computer desk which comprises an upper shelf for receiving a primary computer component, a movable lower shelf positioned below said upper shelf for receiving a computer keyboard, and means for movably supporting said movable lower shelf so that it moves outwardly from the desk such that at least a portion of the lower shelf is in a position which is longitudinally forward of and sufficiently closely adjacent to said upper shelf, so as to extend the total desktop surface of said computer desk, wherein said movable lower shelf comprises a first horizontally aligned section and a second horizontally aligned section adjacent said first section which is forward of and elevated above said first section, and a sloping section interconnecting said first and second horizontally aligned sections, the first horizontally aligned section being dimensioned so as to accommodate said keyboard for storage when the movable shelf is in an unextended state inside the computer desk, and the second horizontally aligned section being dimensioned so as to accommodate said keyboard when the movable shelf is moved into its extended state outwardly of the computer desk so that said keyboard is positioned for use in front of said primary computer component, whereby said keyboard can be moved from the first horizontally aligned section to the second horizontally aligned section.

* * * * *